US009130296B2

(12) United States Patent
Huang et al.

(10) Patent No.: US 9,130,296 B2
(45) Date of Patent: Sep. 8, 2015

(54) POWER JACK WITH A MOVABLE SOCKET COVER

(71) Applicant: HON HAI PRECISION INDUSTRY CO., LTD., New Taipei (TW)

(72) Inventors: Chuan-Ming Huang, New Taipei (TW); Shih-Chang Lin, New Taipei (TW); Hsin-Kuo Dai, New Taipei (TW); Yu-Min Wang, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/210,476

(22) Filed: Mar. 14, 2014

(65) Prior Publication Data

US 2014/0273567 A1 Sep. 18, 2014

(30) Foreign Application Priority Data

Mar. 14, 2013 (TW) ..... 102108927 A

(51) Int. Cl.

| | |
|---|---|
| ***H01R 13/44*** | (2006.01) |
| ***H01R 13/453*** | (2006.01) |
| ***H01R 13/635*** | (2006.01) |
| ***H01R 25/00*** | (2006.01) |

(52) U.S. Cl.

CPC ..... *H01R 13/4538* (2013.01); *H01R 13/635* (2013.01); *H01R 25/003* (2013.01)

(58) Field of Classification Search

CPC ..... H01R 13/4538; H01R 13/4532; H01R 13/447; H01R 13/631; H01R 13/4534

USPC ..... 439/137, 138, 139, 140, 141, 142, 145

See application file for complete search history.

(56) References Cited

U.S. PATENT DOCUMENTS

| | | | | |
|---|---|---|---|---|
| 2,895,119 | A * | 7/1959 | Montgomery, Jr. | 439/354 |
| 5,096,432 | A * | 3/1992 | Cullen et al. | 439/139 |
| 5,252,082 | A * | 10/1993 | Hsieh et al. | 439/141 |
| 5,466,164 | A * | 11/1995 | Miyazaki et al. | 439/140 |
| 5,551,884 | A * | 9/1996 | Burkhart, Sr. | 439/140 |
| 6,146,160 | A * | 11/2000 | Chang | 439/137 |
| 7,144,267 | B1 * | 12/2006 | Huang et al. | 439/352 |
| 8,246,364 | B2 * | 8/2012 | Chen | 439/145 |
| 8,360,791 | B2 * | 1/2013 | Shin | 439/137 |
| 2011/0256745 | A1 * | 10/2011 | Shin | 439/136 |

FOREIGN PATENT DOCUMENTS

CN 201910542 U 7/2011

* cited by examiner

*Primary Examiner* — Hae Moon Hyeon

(74) *Attorney, Agent, or Firm* — Wei Te Chung; Ming Chieh Chang

(57) ABSTRACT

A power jack, comprising an insulating housing, a socket which set in the bottom of the insulating housing, a movable socket cover which covers the socket and an elastic device between the socket cover and the socket which for ejecting the cover; the housing has a pair of limiting portions each having a button assembled thereto; the socket cover has an elastic arm which could clamp the limiting portion, so as to lock the socket cover; the elastic arm can be pushed away from the limiting portion by the button, so that the cover can be removed away from the socket. Therefore, it is convenient and safe for users to extract the plug with single hand.

20 Claims, 8 Drawing Sheets

POWER JACK WITH A MOVABLE SOCKET COVER

BACKGROUND OF THE INVENTION

1. Field of the Invention

The present invention relates to power jacks, more particularly to a power jack with a moveable socket cover.

2. Description of Related Art

China Patent No. 201910542, published on Jul. 27, 2011, discloses a related power jack which includes a base, a socket board mating in the base, several pairs of metal contacts retained in the base and an elastic portion communicates the base with the socket board. The socket board protrudes from the base by the elastic force the elastic portion provides before the power jack works, and every pair of metal contacts are away from each other. When the plug is inserted into the power jack, the socket board is pushed down and it makes the pair of metal contacts get close with each other until clipping the plug, by the time the elastic portion is compressed. When the socket board is pushed to be low enough, a limiting device turns on for fixing the socket board and the plug is clamped tightly by the metal contacts. And when the user pulls the socket board to be low enough again, the limiting device turns off and the socket board moves upwards with the plug by the released elastic portion, while the circuit is off and the plug could be removed easy.

However, when the plug is clipped by the contacts of said power jack, it enhances the force for a user to make the plug on and wears the contacts, what is more, it needs to push the socket board twice for a user finishing the process that turn on and off the power jack. And what is very inconvenient for use.

Hence, an improved power jack is desired to overcome the above problems.

BRIEF SUMMARY OF THE INVENTION

An object of the present invention is to provide a power jack which could reduce the inserting force.

In order to achieve the above-mentioned object, a power jack comprises an insulative housing, a socket retained in the insulative housing and fixed in the bottom thereof, a movable socket cover which covers the socket and an elastic device received between the socket cover and the socket which for ejecting the socket cover. The housing has a pair of limiting portions each having a button assembled thereto; the socket cover has a pair of elastic arms which could clamp the limiting portions, so as to lock the socket cover. When the plug is inserted the socket and working, the socket cover compress the elastic device and the elastic arms clamp the limiting portions. When the plug need to be pulled off, the user could press the button that the elastic arms leave the limiting portions and the elastic device is extract, which makes the plug leave the socket with the socket cover. Therefore, it is convenient and safe for users to extract the plug with single hand.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE PREFERRED EMBODIMENTS

Figure 1:
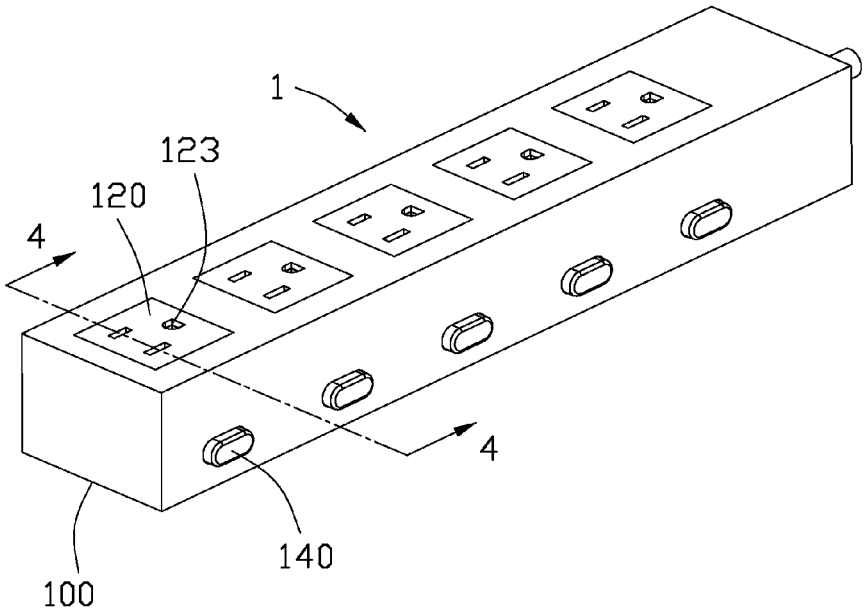
FIG. 1 is a perspective view of a power jack according to a first aspect of the present invention.
Figure 2:
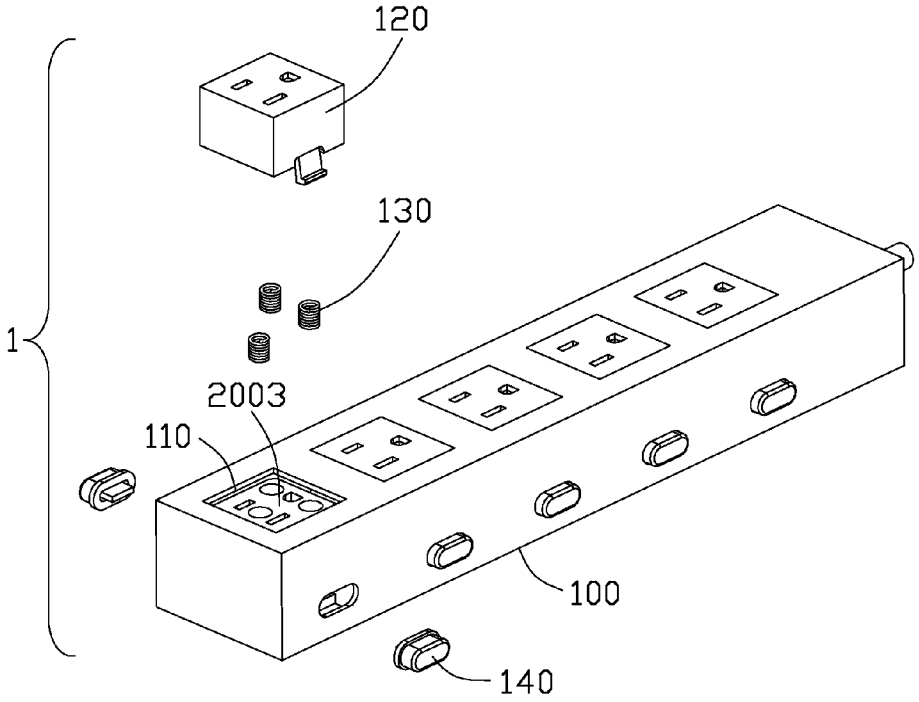
FIG. 2 is a partially exploded view of the power jack shown in FIG. 1.
Figure 3:
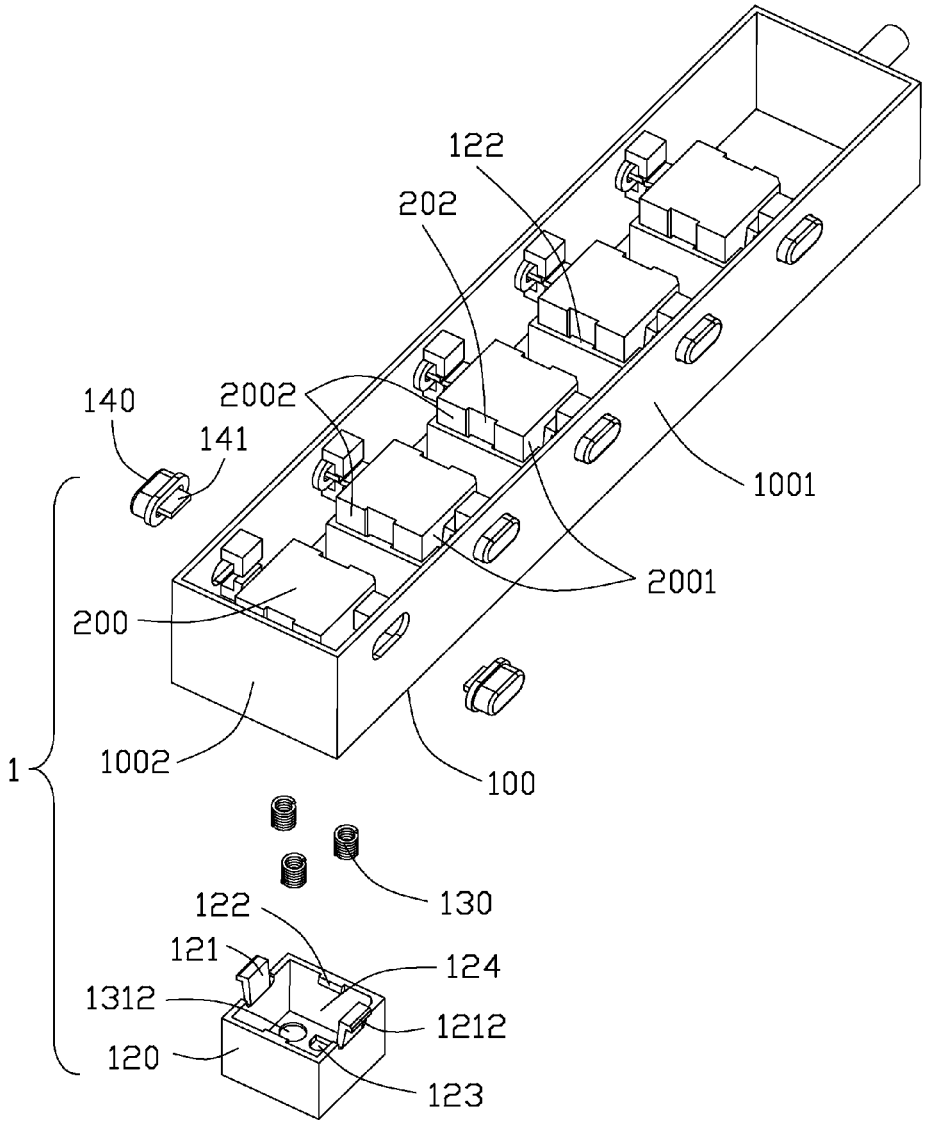
FIG. 3 is a bottom view of the power jack shown in FIG. 2.

Reference will be made to the drawing figures to describe the present invention in detail, wherein depicted elements are not necessarily shown to scale and wherein like or similar elements are designated by same or similar reference numeral through the several views and same or similar terminology. Referring to FIGS. 1-3, according to the present invention, a power jack 1 comprises an insulative housing 100, a socket 200 retained in the insulative housing 100 and fixed in the bottom thereof, a movable socket cover 120 which covers the socket 200 and an elastic device 130 received between the socket cover 120 and the socket 200 which for ejecting the socket cover 120.

Figure 4:
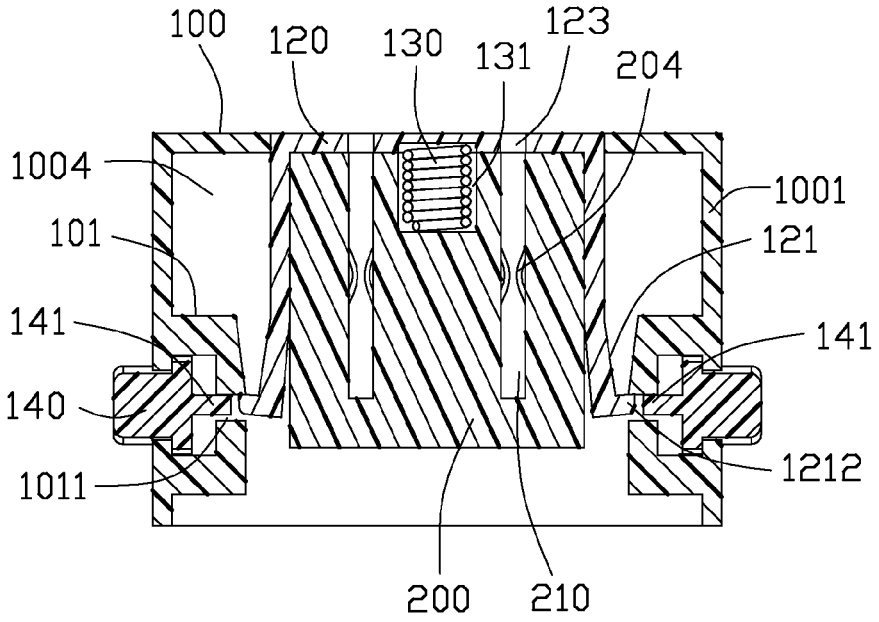
FIG. 4 is a cross section view of the power jack taken along a broken line 4-4 in FIG. 1.

Referring to FIG. 4, the insulative housing 100 is rectangular shaped and comprises two sidewalls 1001, two end walls 1002 which connect with the both end of the sidewalls 1001 and a cavity 1004 formed by the sidewalls 1001 and the end walls 1002. The socket 200 shapes in bulk and comprises a first sidewall 2001, a second sidewall 2002 perpendicular to the first sidewall 2001, and a top wall 2003 which connects the first sidewall 2001 and the second sidewall 2002. The socket 200 comprises two or three slots 210 extend from the top wall 2003 and a pair of electrical clips/contacts 204 retained in each slot 210 for a firm and electrical connection when a mating plug (not shown) inserted.

Figure 5:
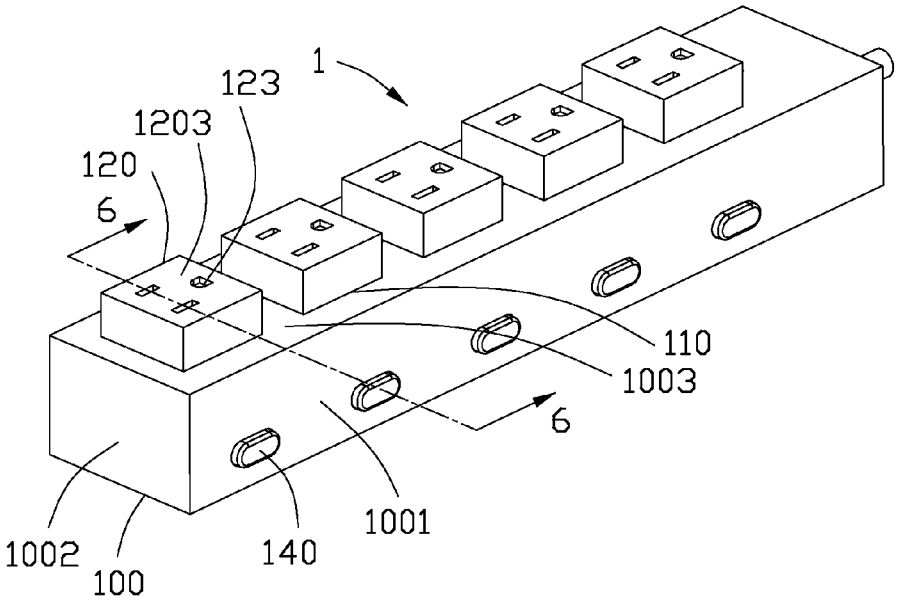
FIG. 5 is a perspective view of the power jack in a releasing situation according the first aspect of the present invention.
Figure 6:
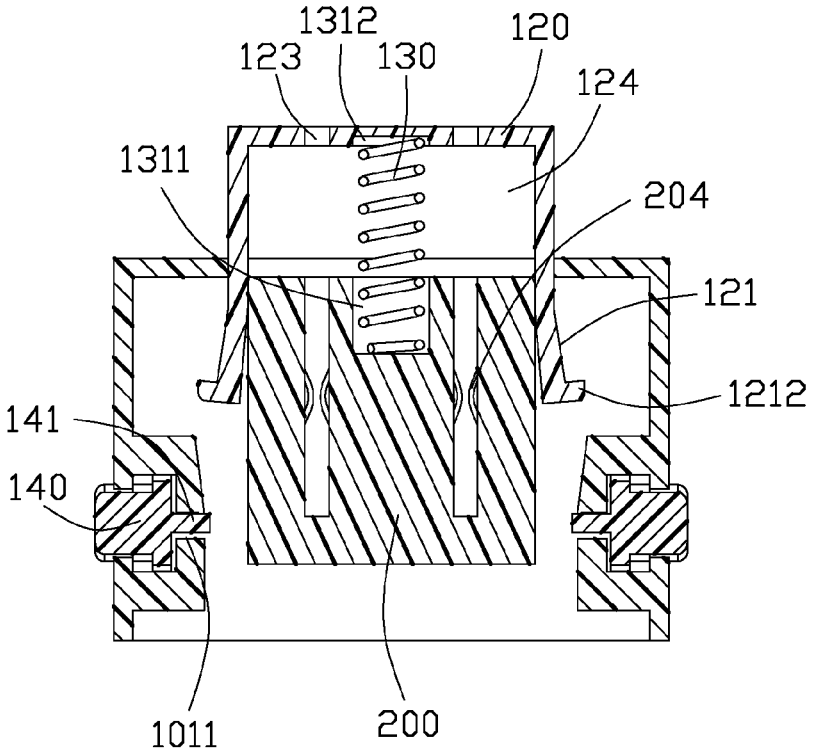
FIG. 6 is a cross section view of the power jack taken along a broken line 6-6 in FIG. 5.
Figure 7:
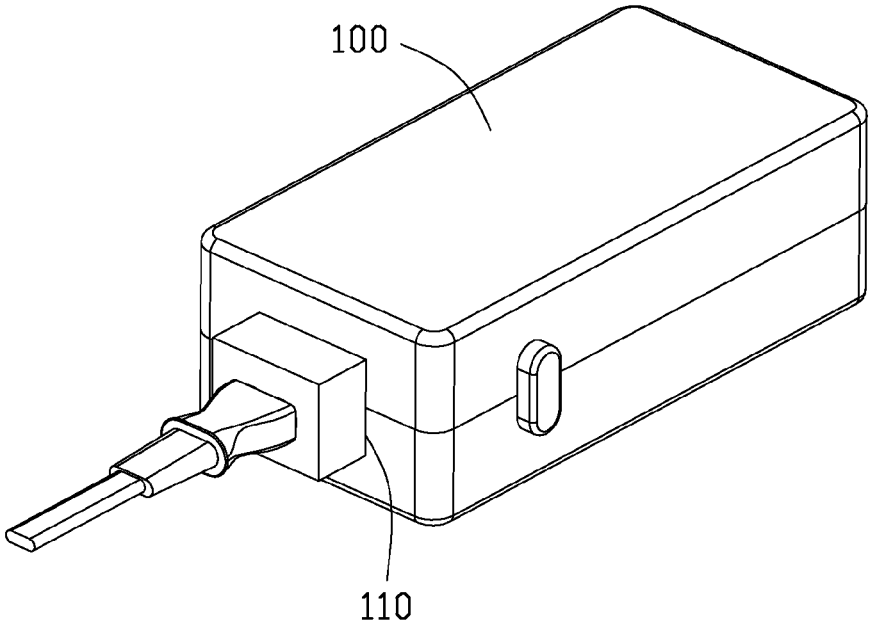
FIG. 7 is a perspective view of a power jack according to another aspect of the present invention.

Referring to FIGS. 4-6, the insulative housing 100 has an upper wall 1003 which connects the two sidewalls 1001 and the two end walls 1002 thereof. The upper wall 1003 defines an opening 110, and the socket cover 120 movably mates with the socket 200 through the opening 110. However, referring to FIG. 7, the opening 110 can also be set in the sidewall according to another aspect of the present invention. The socket cover 120 comprises several holes 123 corresponding to the slots 210 and thereof forming a channel for the user inserts a plug, a cavity 124 for receiving the socket 200, and a pair of elastic arms 121 extending downwardly from the sidewall of the cavity 124 and protruding from the sidewall. The elastic arms 121 corresponds to two limiting portions 101 which set in the two sidewalls 1001 of the insulative housing 100, and each of the elastic arms 121 has a clamping part 1212 for buttoning up or divorcing from the limiting portion 101. There is a button 140 retained in the limiting portion 101 and a mounting hole 1011 defined in the limiting portion 101, and the button 140 has an engaging portion 141 received in the mounting hole 1011. When the power jack is on, the clamping parts 1212 of the elastic arms 121 are clamped into the mounting hole 1011 for fixing the socket cover 120.

Referring to FIGS. 3-4, there is an elastic device 130 received between the socket cover 120 and the socket 200, and the elastic device 130 could be several springs as the figure shown and it could also be other elastic members such like torsion spring, elastic sheet and so on. A shelter 131 is defined between the socket cover 120 and the socket 200 for receiving the elastic device 130, and it comprises a first receiving hole 1311 in the socket 200 and a second receiving hole 1312 in the socket cover 120 for receiving both ends of the elastic device 130 respectively.

When a plug is being inserted into the power jack 1, the socket cover 120 slides with the plug until the power jack 1 turns on, and the plug is electrically clamped by the electrical clips 204. At the same time, the clamping part 1212 of the elastic arm 121 slides into the mounting hole 1011 besides the engaging portion 141 and an upper side of the socket cover 120 aligns with the upper wall 1003 of the insulative housing 100. When the user need to pull the plug off, the user press the button 140 and the clamping portion 1212 could be released from the limiting portion 101 via a pressure from the engaging portion 141 of the button 140 and the elastic device 130 will drive the socket cover 120 slide oppositely to the socket 200 so as to eject the plug out of the socket 200. Finally the upper side of the socket cover 120 protrudes from the upper wall 1003 of the insulative housing 100.

The socket cover 120 protrudes a pair of tubers 122 towards the cavity 124, and the socket 200 defines a pair of notches 202 corresponding to the tubers 122 for a routing slide the socket cover 200 makes. And the notches 202 define a stopper (not shown) respectively for preventing the socket cover 120 being divorced from the socket 200.

Figure 8:
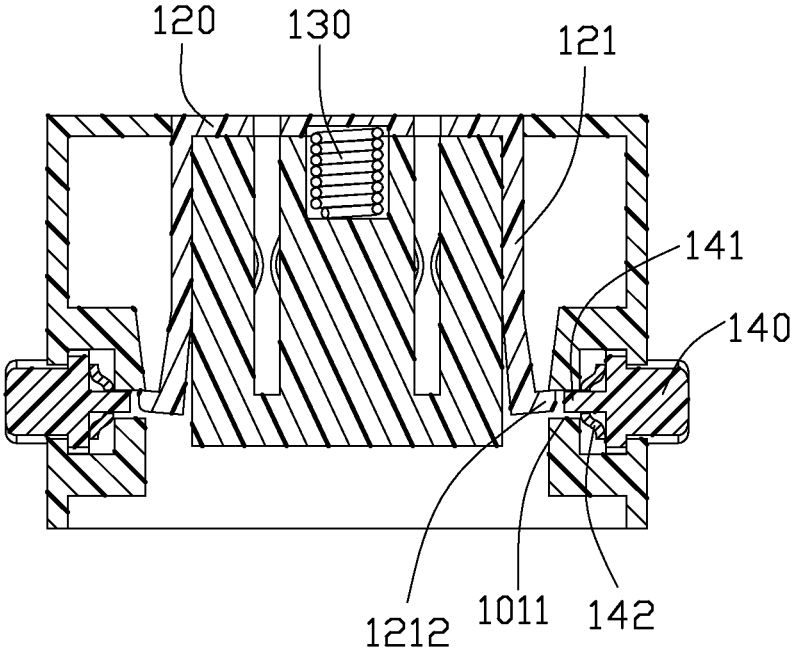
FIG. 8 is a cross section view of the power jack according to another embodiment of the invention.

FIG. 8 shows another embodiment of the power jack 1 wherein the button 140 is equipped with a spring 142 to constantly urge the button 140 toward the outer position while still allowing the button to be inwardly pressed to an inner position for having the engaging portion unlock the clamping part 1212, via deflection of the elastic arm 121, from the mounting hole 1011 so as to have the socket cover 120 to be upwardly moved due to the elastic device 130.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. A power jack comprising, an insulative housing, defining two limiting portions in the two sidewalls of the insulative housing, a button assembled to the limiting portion for a user pressing, and a socket defining a set of slots for insertion of a plug;

a movable socket cover covering the socket, and having a pair of elastic arms corresponding to the limiting portions and a set of holes corresponding to the slots; and an elastic device received between the socket cover and the socket for ejecting the socket cover;

wherein when the plug is being inserted into the slots, the movable socket cover slides towards the socket until the elastic arms are clamped by the limiting portions, and when the plug needs to be pulled off, the user presses the button to urge the elastic arms to leave the limiting portions and the elastic device will drive the socket cover to slide oppositely to the socket so as to eject the plug out of the socket.

2. The power jack as described in claim 1, wherein the socket cover protrudes a pair of tubers inside the sidewall of the socket cover, and the socket defines a pair of notches corresponding to the tubers for a routing slide the socket cover makes, and the notches define a stopper respectively for preventing the socket cover being divorced from the socket.

3. The power jack as described in claim 1, wherein the elastic device could be several springs, torsion spring or elastic sheet.

4. The power jack as described in claim 1, wherein the socket has a first receiving hole for receiving one end of the elastic device.

5. The power jack as described in claim 4, wherein the socket cover has a second receiving hole corresponding to the first receiving hole for receiving another end of the elastic device.

6. The power jack as described in claim 1, wherein the limiting portion defines a mounting hole and the elastic arm has a clamping portion, wherein the clamping portion slides into the mounting hole.

7. The power jack as described in claim 6, wherein the button has an engaging portion received in the mounting hole to push the clamping portion away from the mounting hole.

8. A power jack comprising, an insulative housing, defining an opening in an upper wall of the insulative housing, two limiting portions in two sidewalls of the insulative housing, a button assembled to the limiting portion for a user pressing, and a socket defining a set of slots for insertion of a plug;

a movable socket cover passing through the opening and covering the socket, the socket cover having a pair of elastic arms corresponding to the limiting portions and a set of holes corresponding to the slots; and an elastic device received between the socket cover and the socket for ejecting the socket cover;

wherein when the plug is being inserted into the slots, the movable socket cover slides towards the socket until the elastic arms are clamped by the limiting portions, and finally an upper side of the socket cover aligns with the upper wall of the insulative housing, and when the plug needs to be pulled off, the user presses the button to urge the elastic arms to leave the limiting portions and the elastic device will drive the socket cover to slide oppositely to the socket so as to eject the plug out of the socket, and finally the upper side of the socket cover protrudes upwardly beyond the upper wall of the insulative housing.

9. The power jack as described in claim 8, wherein the socket cover protrudes a pair of tubers inside the sidewall of the socket cover, and the socket defines a pair of notches corresponding to the tubers for a routing slide the socket cover makes, and the notches define a stopper respectively for preventing the socket cover being divorced from the socket.

10. The power jack as described in claim 8, wherein the socket has a first receiving hole for receiving one end of the elastic device.

11. The power jack as described in claim 10, wherein the socket cover has a second receiving hole corresponding to the first receiving hole for receiving another end of the elastic device.

12. The power jack as described in claim 8, wherein the limiting portion defines a mounting hole and the elastic arm has a clamping portion, wherein the clamping portion slides into the mounting hole.

13. The power jack as described in claim 12, wherein the button has an engaging portion received in the mounting hole to push the clamping portion away from the mounting hole.

14. A power jack comprising:

an insulative housing defining a pair of upward slots for receiving corresponding plug blades in a vertical direction;

a pair of electrical contacts disposed in the housing with contacting sections extending into the corresponding slots, respectively;

a cover mounted upon the housing and up and down moveable in said vertical direction between opposite upper and lower positions relative to the housing, and equipped with a clamping part to retain the cover to the housing when the cover is located in the lower position;

an elastic device located between the cover and the housing to constantly urge the cover to the upper position; and one of the housing and the cover being equipped with an elastic arm actuated to be deflected by a button and associatively operable with said clamping part to have the clamping part unlocked from the housing when the button is moved from a first position to a second position relative to the housing so as to have the cover moved from the lower position to the upper position, due to a resilient force of said elastic device, for disengaging the plug blades from the electrical contacts.

15. The power jack as claimed in claim 14, wherein the elastic arm is formed with the cover.

16. The power jack as claimed in claim 15, wherein the clamping part is integrally formed with the elastic arm.

17. The power jack as claimed in claim 14, wherein the cover is equipped with a pair of through holes in alignment with the corresponding slots in the vertical direction, respectively.

18. The power jack as claimed in claim 14, wherein the elastic arm is deflectable in a lateral direction perpendicular to said vertical direction.

19. The power jack as claimed in claim 14, wherein the first position is an outer position while the second position is an inner position.

20. The power jack as claimed in claim 19, further including a spring constantly abut against and urge the button toward the outer position.

* * * * *